United States Patent [19]

Koenecke

[11] 4,171,254

[45] Oct. 16, 1979

[54] SHIELDED ANODES

[75] Inventor: Donald F. Koenecke, Westfield, N.J.

[73] Assignee: Exxon Research & Engineering Co., Florham Park, N.J.

[21] Appl. No.: 826,526

[22] Filed: Aug. 22, 1977

Related U.S. Application Data

[63] Continuation-in-part of Ser. No. 755,572, Dec. 30, 1976, abandoned.

[51] Int. Cl.[2] ..... C23F 13/00; C25B 11/00

[52] U.S. Cl. ..... 204/197; 204/290 R

[58] Field of Search ..... 204/290 R, 196, 197

[56] References Cited

U.S. PATENT DOCUMENTS

| | | | |
|---|---|---|---|
| 2,855,358 | 10/1958 | Douglas | 204/197 |
| 3,196,101 | 7/1965 | Hosford, Jr. | 204/196 |
| 3,527,685 | 9/1970 | Anderson | 204/290 R X |
| 3,809,640 | 5/1974 | Jacob | 204/197 |

*Primary Examiner*—John H. Mack
*Assistant Examiner*—D. R. Valentine
*Attorney, Agent, or Firm*—F. Donald Paris

[57] ABSTRACT

A shielded anode for use in controlling corrosion, for example, in a truck or a tanker, comprising a perforated plastic shield encompassing the anode and having a hinged flap on opposite sides thereof supporting at its free end a float member, such that the flap will lift from closed or down position to a raised position due to buoyancy of the float member during immersion of the anode. When the tank in which the shielded anode is located is empty, the flaps will close, thus protecting the anode due to hazards which may result from falling or contact with other metal bodies. The aforesaid hinge may take the form of a living hinge, i.e. integrally with the shield, and in conjunction with the integral float member will permit the anode to function normally to prevent or at least minimize corrosion while still providing the desired protection against sparks caused by falls or other accidents. Another embodiment may comprise a single shield continuously disposed about the anode and sealed at opposite ends such as by end cover, of sufficient thickness to withstand impact and having spaced anode vent holes.

14 Claims, 9 Drawing Figures

SHIELDED ANODES

CROSS REFERENCE TO RELATED APPLICATION

This application is a continuation-in-part application of U.S. Ser. No. 755,572, filed Dec. 30, 1976 now abandoned, assigned to the same assignee of the present application and invention, which is incorporated herein by reference.

BACKGROUND OF THE INVENTION

The present invention relates to anodes for use in controlling corrosion and more particularly to providing a protective shield for such anodes so that the anode will perform its normal corrosion prevention function when immersed and will prevent accidental impact between the anode and other metallic objects or structures due to falls and/or accidents involving the anode.

Typically the corrosion of metals in sea water and other aqueous environments is an electrochemical process, wherein a flow of electrons takes place between certain areas of the metal surface in contact with the aqueous solution which is capable of conducting an electric current. The results of this electrochemical process is deterioration or eating away of the metal in those areas which are commonly referred to as anodes and at which the electrons leave the metal. Metal ions enter into the solution and the metal corrodes. The area receiving the electrons and becoming more negative is termed the cathode. There, electrons are discharged to the electrolyte. The cathode also must be present to complete a circuit. These two electrodes may comprise different metals or different areas on the same piece of metal due to impurities on the surface, differences in surface structure, etc. A common and well-known example of such an electrochemical action is the dry cell battery principle which provides energy to make the flashlight operate. Another similar example is an unprotected hull of the ship in sea water, the primary difference being that there is no switch to cut off the flow of electrons and, furthermore, the presence of the reaction is undesirable. In the case of a ship's hull, since the amount of electrons the earth can accept is near infinity, the process will continue until the hull is completely wasted away and as long as the flow of electrons is unimpeded through a path of low resistance the rate of wastage will be very rapid.

This electron flow is generally termed a galvanic process. If uncontrolled, it will tend to continue in the absence of the application of an equal or greater opposing force, which if applied, can greatly reduce the rate of the galvanic process or corrosion can be stopped completely. This is accomplished by supplying a sufficient number of electrons from another more powerful source so that the supply will make the structure to be protected the cathode. Corrosion, i.e. oxidation, does not occur at the cathode. The application of such an opposing force would provide the surplus of electrons without a loss of steel and is well known as cathodic protection. Using this type of protection means being prepared to sacrifice another material or energy for that purpose, which is the primary function of cathodic protection. By permitting the electrons from the galvanic anode to flow to a tanker hull or tank surface which has a more positive potential, i.e. cathodic, the desired protective function is obtained. The rate of electron flow depends on the driving force or potential difference between the metals, i.e. the voltage difference between the corroding site known as the anode and the protected site known as the cathode.

In the case of unprotected tanks, corrosion also takes place although there is no dissimilarity in metals. The corrosion is substantial because of the basic principle involved which is the same as explained above. Thus, surface imperfections, orientation of grains in a granular structure of the metal, lack of homogeneity, localized stresss and variations in environment cause the formation of large number of localized anodes and cathodes on the surface of the metal. The galvanic action results in anodic corrosion, i.e. corrosion at the anode site in comparison to the protected site which is the cathode. This corrosion is commonly prevented or at least minimized by using sacrificial anodes which are typically cast on support rods or cores and fixed at various locations through the tank in order to provide for complete protection of the tank. Hence, it is often desirable to place anodes at many elevations from top to bottom. Generally, the schemes employed for mounting the anodes are regulated by the U.S. Coast Guard. Presently various ship classification societies and the U.S. Coast Guard permit installation of aluminum anodes only in the lower levels of ballast tanks and other locations where a free fall of the anode cannot result in an impact of more than 200 foot pounds energy. Impacts of greater energy between hot aluminum and rusty steel can produce aluminum fragments capable of igniting petroleum gases. Present practice permits installation of the zinc anodes at greater heights because impact between zinc and steel are less hazardous.

It is apparent that in order to achieve a completely safe anode environment system, it is desirable to completely eliminate any metal-to-metal impact possibilities. The hazard of such impact is especially severe since there is a tendency to form a metallic smear on a target surface such as the steel structure which can result in a highly incendive thermit reaction. If these objectives to eliminate such impacts can be met, then the use of aluminum anodes will be safe at any elevation in the tank.

Various attempts at protection of anodes have been proffered in the prior art. These include those such as disclosed in U.S. Pat. No. 3,488,275, which provide protection from physical abuse during shipping in the form of a fabric container for the anode. U.S. Pat. No. 2,976,226 generally discloses providing a sleeve on an anode to protect against oil or reaction products but not impact; however, the anode is of the impressed current type variety. U.S. Pat. No. 3,196,101 provides a mesh wrapped about an impressed current anode for protecting it against any falling pieces, but does not suggest protecting against metal-to-metal impact. Other prior art such as U.S. Pat. No. 2,855,358 and 3,527,685 are considered deficient at least for the reason that they will not withstand the impacts for which the present invention was designed and still permit the anode to function normally when immersed in electrolyte.

SUMMARY OF THE INVENTION

The present invention relates to anodes and more particularly to a shielded anode adapted for use to prevent corrosion such as in a ballast tank on a tanker. According to one embodiment, the shielded anode comprises a protective plastic shield including hinged flaps which cover and protect the anode when the tank is free of liquid, e.g. ballast. When the tank is ballasted with sea water, an integral float connected with the hinged flaps of the shield causes the flaps to raise to permit the protective anode current to flow freely with respect to the tank structure, thus preventing corrosion. The shield, preferably of plastic, basically comprises a fixed perforated portion on the sides and solid or perforated movable side flaps operably connected at one end through a living hinge with fixed portion of the shield and at the opposite end supporting a buoyant member or float. The top of the shield is perforated and continuous and the shield can be sealed at opposite ends (not shown) of the anode to maintain it in place or may have other alternate means such as extending part of the shield about the bottom of the anode body. Also the shield may include a bottom (like the top shown) and they can be heat sealed together or sealed by other conventional means. Another embodiment provides a single shield continuously disposed about the anode and sealed at opposite ends such as by an end cover, of sufficient thickness to withstand substantial impacts and having spaced anode vent holes throughout.

Accordingly, it is a primary object of the present invention to provide a protective shield for an anode which permits normal operation of the anode when immersed and provides a protective cover for the anode when not immersed to withstand substantial impacts.

Another object of this invention is to provide an improved protective plastic shield for an anode adapted for use in ballast tanks or tankers and which includes a fixed perforated portion and a hinged movable portion which permits operation of the anode to prevent corrosion when immersed and provides a protective cover for the anode when not immersed.

Still a further object of this invention is to provide an improved protective shield for an anode which completely surrounds the anode and can withstand substantial impact while permitting it to function normally when immersed in electrolyte.

The foregoing and other objects, features and advantages of the invention will be apparent from the following more particular description of the preferred embodiments of the invention as illustrated in the accompanying drawings.

DESCRIPTION OF THE PREFERRED EMBODIMENTS

It has generally been described that cathodic protection with sacrificial anodes is a primary method employed to prevent or minimize corrosion in ballast tanks on liquid carrying tankers. To insure and provide for adequate safety, it is necessary to prevent, especially in the case of employing aluminum anodes, aluminum-metal impacts with forces exceeding, for example 200 ft. lbs. The present invention is directed towards the shielding of anodes with a plastic guard or protective casing to accomplish this end. In order to achieve total safety, this would depend upon eliminating any metal-to-metal impact possibilities and in particular any metal aluminum impacts. The occurrence of aluminum smears which can be an impact target for a falling object also must be prevented and by accomplishing these objectives which the present invention does, aluminum anodes can be employed as safely as zinc. The invention also has utility in reducing the potential impact energy of steel-on-steel compared to that which could occur with the fall of the heavier zinc anode. Towards this end the anode is sheathed in a plastic protective casing which eliminates direct contact with another metal structure.

Figure 1:
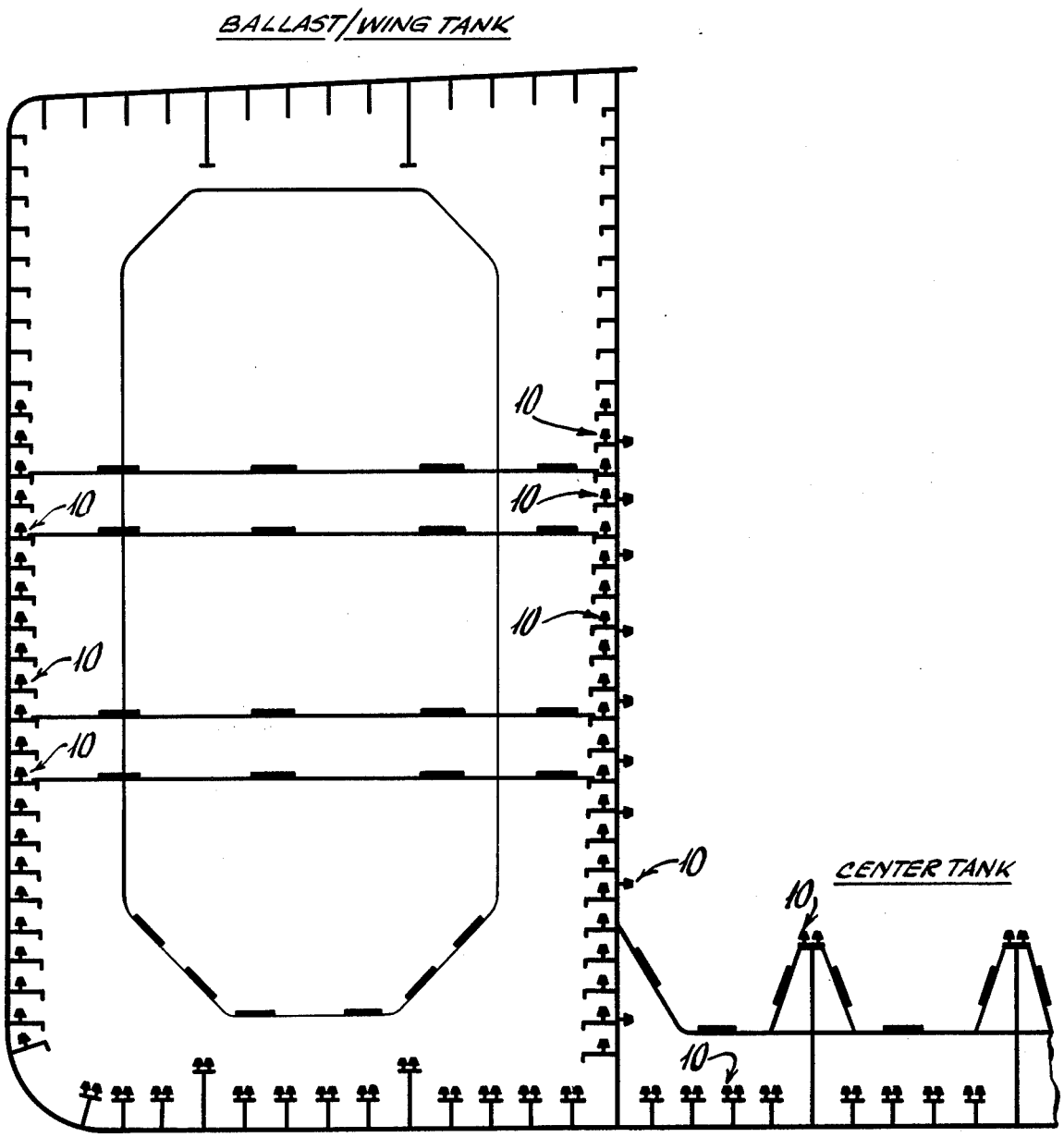
FIG. 1 is a typical transverse section of a wing tank and part of a center tank in a tanker for carrying liquid hydrocarbon or sea water ballast and which includes an array of anodes positioned in accordance with conventional practice and constructed in accordance with the present invention.
Figures 2, 3, 4, 5, 6:
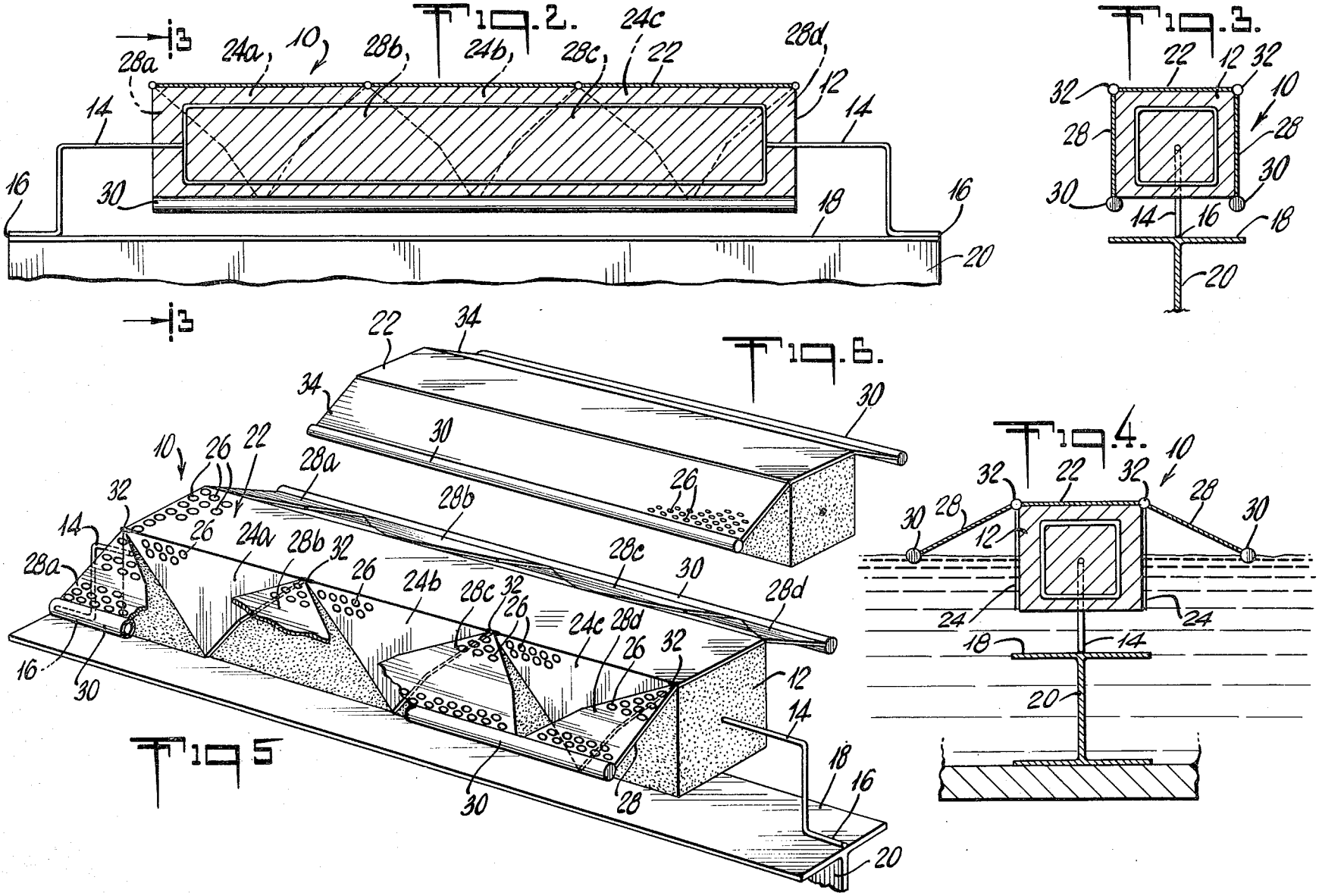
FIG. 2 is a side elevational view of a typical anode mounted in the tank of FIG. 1 and constructed in accordance with the present invention.
FIG. 3 is a cross-sectional view taken substantially on the line 3—3 of FIG. 2 illustrating the anode protective shield when the tank is empty.
FIG. 4 is a cross-sectional view of the anode similar to FIG. 3 illustrating the anode protective shield with the anode immersed.
FIG. 5 is a perspective view of the anode and its protective shield in the position of FIG. 4.
FIG. 6 is an alternate embodiment of the present invention illustrating the protective shield in its open position.

FIG. 1 illustrates a typical section through the standard ballast and central tanks on a tanker and schematically shows an array of anodes constructed according to the present invention and generally designated 10 which are situated through the tank located on the various structural members of the tank. The particular arrangement of the anodes is not deemed to be a part of the present invention and is merely shown for purposes of illustration. Reference is made to FIGS. 2 through 5 for further details on the construction of the anode shield which will be described in conjunction with their mounting which is considered conventional, although described for purposes of completeness of this disclosure. Each anode typically comprises a main anode body 12 which may have any suitable shape such as a trapezoidal cross-section or rectangular as shown in the present drawings. The body is elongated and has extending through the body and outward at each end steel support rods 14 which are bent downwardly and then outwardly at right angles to the downward extending portion in order to provide a means for mounting the anode to the tank structure. The end portion of the rod may be welded as shown at 16 to the standard flange 18 of the bottom hull stiffeners 20 which are secured to the bottom hull of the tanker. The anode is sheathed in a plastic casing 22 which will eliminate direct contact with other metal structures as described in further detail hereinafter. The anode shield may comprise a suitable material such as polypropylene or nylon which has the necessary properties of high impact resistance, being resistant to oil and water, and which does not deteriorate objectionably while aging in service. A suitable manufacturing process for the shield would be by molding in order to obtain the desired casing geometry for the anode. A heat seal may be employed in order to secure the shield about the anode; however, other alternatives such as riveting or clamping also can be employed. The illustrated sheathing comprises a fixed perforated portion 24 having openings 26 extending therethrough in order to permit the flow of electricity between the anode and the tank walls. The fixed portions extend for the length of the anode on either side of the body and may completely cover the end surfaces thereof as well as encasing the top and bottom (if desired) surfaces of the anode. The fixed shield portions comprise a plurality (shown as three) of generally triangular sections 24*a*, 24*b*, 24*c* equally spaced along the sides and having their apex at the bottom and having triangular spaces therebetween which expose the anode surface. This is done in order to provide for relatively free flow of the corrosion arresting or protecting electricity currents when the anode is immersed in an electrolyte within the tank. The second portion of the sheathing comprises movable flap portions 28 on opposite sides which open and close in response to liquid in the tank. At the free or bottom end of each flap, which may or may not be perforated, is a hollow float member 30 connected with each of the flap sections. The upper end of the flaps are secured at points between adjacent sections of the fixed perforated shield at the top of the anode by means of hinges generally designated 32 which employ a polypropylene "living hinge" principle. This principle relies on the fact that continuous working of the hinge actually strengthens the plastic, at the bend location by orientation of the polymer molecules. The hinges 32 are designed so that in cooperation with the hollow float 30 it will lift the flaps primarily due to buoyancy of the float during immersion of the anode, i.e. when the tank is filled with liquid, thus permitting the anode to be completely operable during ballast or tank filled conditions. This is best illustrated in FIGS. 4 and 5 wherein the flaps are in their raised position which is designed to be at about an angle of about 60–70 degrees with respect to a vertical plane or in other words about 20–30 degrees with respect to the plane of the top and bottom surfaces. When the tank is empty, which is also the period during which there exists potential hazards such as falling objects, and the anode is not functional or needed because the electrolyte has been removed, the flaps close thus covering and protecting the anode completely. The perforations 26 may only be in the fixed portions (top, bottom, partly on sides) of the shield. If desired, perforations also may be provided in the flaps with a minimum effect on the anode function and could be desirable in the event that the hinge malfunctions and the flaps do not raise. Thus, the perforations in the flap during ballast, thus avoiding the total loss of necessary corrosive protection. The flaps are designed to comprise basically four sections 28*a*, 28*b*, 28*c*, and 28*d*, each of which is designed to be and is complementary to the openings or spaces between the adjacent fixed shield portions and at the ends thereof. Thus, each of the flap sections are aligned to overlay an exposed anode surface when the flaps are closed. The general configuration of each flap section is also triangular in shape; however, it should be understood that it is within the contemplation of this invention for the fixed shield portions and the flap sections to comprise a more conventional configuration, i.e. rectangular or other convenient geometric shapes, and it is also within the scope of this invention to provide a continuous elongated flap 34 such as shown in FIG. 6. In this embodiment, the flaps also shown as having perforations 26 are operated in a fashion similar to that described heretofore in connection with FIGS. 2 through 5, only there is provided an elongated continuous flap for the length of the anode.

Figure 7:
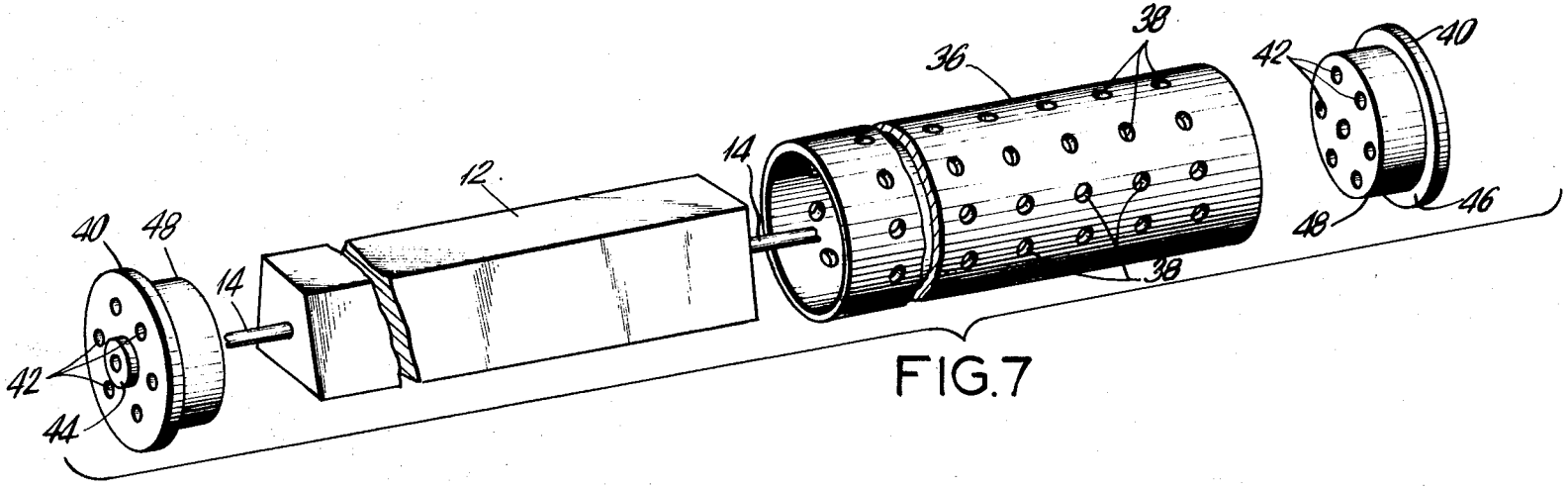
FIG. 7 is an exploded perspective view of a shielded anode according to a further embodiment of this invention.
Figure 9:
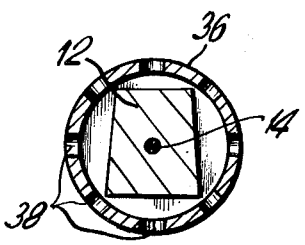
FIG. 9 is a cross-sectional view taken substantially on the line 9—9 of FIG. 8.
Figure 8:
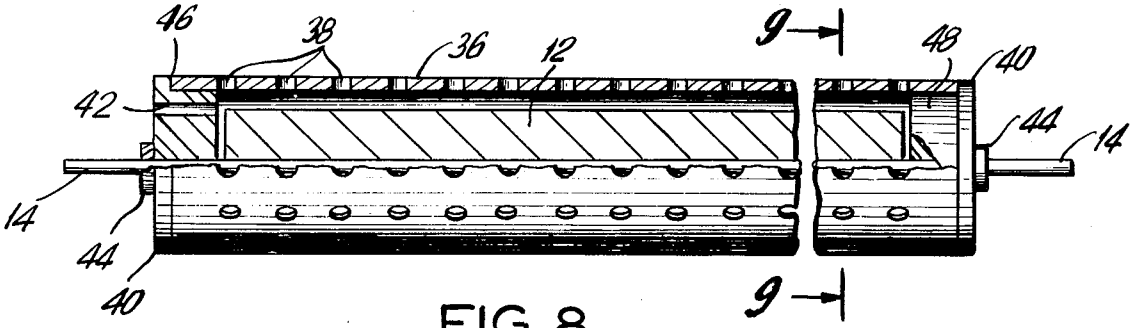
FIG. 8 is a side view, in partial cross-section, of the shielded anode of FIG. 7.

A further embodiment is shown in FIGS. 7–9 wherein the anode body 12 is shown to have a trapezoidal cross-section although any other configuration such as that described and shown in connection with FIGS. 1–6 also can be used. In this embodiment the sheathing comprises a single shield casing 36 which is a cylindrical tube extending continuously about the anode 12. The shape of the shield may take any suitable shape however, such as a rectangular casing which extends completely about the anode. Spaced openings 38 comprise anode vent holes which extend about and for the length of the shield to permit protective current flow between the tank wall and the anode. The casing typically may be ⅜ inch uniformly thick, with the actual thickness determined by the expected impact which it must withstand. The shield should be capable of withstanding impacts of greater than 200 ft. lbs. The shield as described heretofore must be conductive at least on its inner and outer surfaces which can be accomplished by making the inner and outer layers of the shield of conductive resin; (this) will keep the shield from becoming an isolated charge collector) with the intermediate layers of a suitable hard material, e.g. a layered fiber reinforced plastic material. At each end of the shield when the anode is disposed therein is a molded conductive end cover 40 also having openings 42 extending therethrough with the central one of the openings receiving the steel anode core support rod 14 (which generally extends through the anode). These covers can be of the same material as the shield and are conventionally secured to the shield in a number of ways such as by an allen key collar coupling 44 or the like so that the covers can be easily removed for changing the anode. The cover has a peripheral flange 46 which abuts against the ends of the casing and a central portion 48 which extends axially inward and is of substantially the same diameter as the inner diameter of the casing. The shield 26 is disposed about the anode preferably so that there is a continuous (or at least substantially so on the sides, top and bottom) space between them. This can be accomplished by providing internal protrusions (e.g. molded) which will abut the anode at various locations for maintaining the spacing. The advantages of the single shield disclosed herein is that it can be made to completely surround and thereby protect the anode on all sides, while permitting the anode to function normally when immersed. Also manufacture of the single wall casing is economically feasible because it can be formed as a single elongated casing (cylindrical, rectangular, etc.) and cut into appropriate lengths.

While preferred embodiments and various modifications thereof have been disclosed, it will be apparent to those of ordinary skill in the art upon reading this disclosure that other modifications and variations can be made. Accordingly, reference should be made to the appended claims for determining the full and complete scope of the present invention.

What is claimed is:

1. A shielded anode adapted for withstanding impacts and providing cathodic corrosion protection when immersed in an electrolyte, comprising: a main anode body and substantially rigid protective shield means completely surrounding said body in spaced relation thereto for protecting said anode body against direct contact with other structures and withstanding substantial impact, said shield having end covers secured at opposite ends thereof for supporting said anode body in said spaced relation and including a plurality of spaced perforations extending through and about and for the length of said shield at predetermined locations for permitting said anode to be in contact with said electrolyte and to perform its normal cathodic protective function when immersed.

2. The shielded anode of claim 1 wherein said shield means is constructed to withstand impacts of greater than 200 ft. lbs.

3. The shielded anode of claim 1 wherein said anode body comprises aluminum.

4. The shielded anode of claim 1 wherein said anode body comprises zinc.

5. A shielded anode adapted for withstanding impacts and providing corrosion protection when immersed in an electrolyte comprising: a main anode body and a plastic shield for said body, said shield comprising a fixed portion covering at least the top of said body and at least covering predetermined portions of side surfaces thereof, and first and second movable portions hingedly connected with said fixed portion, said shield including at least in said fixed portion a plurality of spaced perforations at predetermined locations for permitting said anode to function normally when immersed, and hinge means operably connecting said first and second movable portions to said fixed portion on opposite sides, said movable portion normally disposed in a closed position overlying any exposed portions of said anode body on said side surfaces when not immersed and being buoyant for location in a raised position when said shielded anode is immersed, whereby said shield protects said anode against incendive sparks caused by falls and other accidents involving said anode.

6. A shielded anode adapted for withstanding impacts and providing corrosion protection when immersed, comprising: a main anode body and substantially rigid protective shield means for said body for protecting said anode body and withstanding substantial impact, said shield means including a plurality of spaced perforations at predetermined locations for permitting said anode to function normally when immersed, said shield means comprising a fixed portion and a movable portion, said fixed portion covering at least the top surface of said anode body and at least covering predetermined portions of opposed side surfaces of said body, said fixed portion having a plurality of spaced perforations, and hinge means operably connecting said movable portion to said fixed portion on opposed sides of said anode body, said movable portion normally disposed in a closed position overlying any exposed portions of said anode body on said side surfaces and being buoyant for location in a raised position when said shielded anode is immersed.

7. The shielded anode of claim 6 wherein said hinge means comprises a flexible portion integrally formed between said fixed portion and said movable portion on said opposed sides.

8. The shielded anode of claim 7 wherein said movable portion includes spaced perforations.

9. The shielded anode of claim 6 wherein said fixed portion on said sides comprises a plurality of spaced sections with surfaces of said anode body being exposed at least between adjacent sections, said movable portion on each side comprising a plurality of interconnected spaced sectioms for overlying the exposed surfaces of said body when in a closed position adjacent said sides.

10. The shielded anode of claim 9 wherein said spaced sections comprise a generally triangular configuration with the base thereof situated at and adjacent said fixed portion at said top.

11. The shielded anode of claim 6 wherein said fixed portion is continuous and includes perforations.

12. The shielded anode of claim 6 including buoyant means at the free end of said movable portion.

13. A shielded anode adapted for withstanding impacts and providing corrosion protection when immersed, comprising: a main anode body and substantially rigid protective shield means for said body for protecting said anode body and withstanding substantial impact, said shield means including a plurality of spaced perforations at predetermined locations for permitting said anode to function normally when immersed, and further including a fixed portion on said anode body which surrounds only the top and opposed sides of said anode body.

14. A shielded anode adapted for withstanding impacts and providing corrosion protection when immersed, comprising: a main anode body and substantially rigid protective shield means disposed completely about said body for protecting said anode body and withstanding substantial impact greater than 200 ft. lbs., said shield including a plurality of spaced perforations at predetermined locations for permitting said anode to function normally when immersed, and removable end covers secured at opposite ends of said shield means.

* * * * *